US009816794B1

(12) United States Patent
Rice

(10) Patent No.: US 9,816,794 B1
(45) Date of Patent: Nov. 14, 2017

(54) BLASTING PLUG

(71) Applicant: William Jordan Rice, Mt Juliet, TN (US)

(72) Inventor: William Jordan Rice, Mt Juliet, TN (US)

( * ) Notice: Subject to any disclaimer, the term of this patent is extended or adjusted under 35 U.S.C. 154(b) by 0 days.

(21) Appl. No.: 15/407,837

(22) Filed: Jan. 17, 2017

(51) Int. Cl.
*F42D 3/00* (2006.01)
*F42D 1/18* (2006.01)
*F42D 1/22* (2006.01)

(52) U.S. Cl.
CPC *F42D 1/18* (2013.01); *F42D 1/22* (2013.01)

(58) Field of Classification Search
CPC ..... F42D 1/18; F42D 1/22
See application file for complete search history.

(56) References Cited

U.S. PATENT DOCUMENTS

| | | | | | |
|---|---|---|---|---|---|
| 1,848,129 | A * | 3/1932 | Hodge | F42D 1/18 | 102/333 |
| 2,916,995 | A | 5/1956 | Douglass | | |
| 3,151,556 | A | 7/1961 | Karpovich | | |
| 5,841,060 | A * | 11/1998 | Skaggs | F42D 1/18 | 102/333 |
| 5,936,187 | A * | 8/1999 | Miller | F42D 1/18 | 102/333 |
| 2009/0314177 | A1* | 12/2009 | Laszlo | F42D 1/08 | 102/333 |
| 2016/0326828 | A1* | 11/2016 | Phillips | F16L 55/1141 | |

FOREIGN PATENT DOCUMENTS

| | | | | |
|---|---|---|---|---|
| AU | GB 2211587 A * | 7/1989 | | F24D 1/18 |
| FR | 2803654 A1 * | 7/2001 | | F24D 1/18 |

* cited by examiner

*Primary Examiner* — Gabriel Klein
(74) *Attorney, Agent, or Firm* — Shane Cortesi

(57) ABSTRACT

An elastomeric blasting plug and method of using the same are described. The elastomeric blasting plug may include a plurality of stacked units that taper from a base to a stem. A fuse may extend through the elastomeric blasting plug and the elastomeric blasting plug may expand radially after detonating the fuse and explosive charge.

9 Claims, 2 Drawing Sheets

BLASTING PLUG

BACKGROUND

Technical Field

The present invention relates to explosion accessories, namely, blasting plugs that are placed above explosive charges in holes.

Background of the Invention

Explosives are sometimes placed in bore holes formed in the ground in order to increase the effectiveness of the charge. In addition, stemming a loaded bore hole helps to protect the explosive charge from accidental ignition by sparks or fire and also assists in maintaining the charges in a predetermined relationship in the hole prior to detonation.

U.S. Pat. No. 3,151,556 describes a blasting plug that is made out of steel and has an undersized width/diameter relative to the hole width/diameter. As a result of the size difference, the blasting plug must rest on the explosive charge. In addition, the plug of U.S. Pat. No. 3,151,556 is problematic because steel cannot be used near bore holes because it sparks.

U.S. Pat. No. 2,916,995 describes a blasting plug that includes a cylinder with flexible radial fins that displace upon placement of the blasting plug in the bore hole. The blasting plug is said to have a larger diameter than the diameter of the bore hole so that when the blasting plug is forced into the bore hole, the radial fins will be deformed into the shape of rearwardly directed cups. The blasting plug of U.S. Pat. No. 2,916,995 does not expand laterally; rather, the explosive is ignited by electrical wires denoted by numeral 5 that pass along the side of the blasting plug to trigger a blasting cap in the main charge so no laterally force is imparted to the blasting plug.

BRIEF SUMMARY

The present disclosure provides a blasting plug and method of using the same as described herein. In some embodiments, the method includes a) forming a hole in the ground, the hole having a hole height and a hole width/diameter perpendicular to the hole height;

b) placing an explosive charge in the hole;

c) providing an elastomeric blasting plug having a top end, a bottom end, an elastomeric blasting plug height extending from the top end to the bottom end, the elastomeric blasting plug having a relaxed state in which the elastomeric blasting plug comprises a plurality of stacked units comprising an upper unit and an adjacent lower unit located below the upper unit, each unit having a substantially circular base having a base diameter, and a stem located below the base, the stem having a stem diameter, a stem top end, a stem bottom end, and a stem height extending from the stem top end to the stem bottom end and generally parallel to the elastomeric blasting plug height and generally perpendicular to the stem diameter, the elastomeric blasting plug tapering in diameter from the base to the stem top end, the stem top end and the stem bottom end having a reduced diameter compared to the base diameter, the stem diameter substantially constant diameter along the stem height, and further wherein the stem bottom end of the upper unit adjoins the base of the adjacent lower unit located below the upper unit;

d) placing the elastomeric blasting plug above the explosive charge; and e) detonating the explosive charge to cause the elastomeric blasting plug to move to an expanded state in which the stem diameter is increased relative to the relaxed state and in which the elastomeric blasting plug is substantially cylindrical in shape.

Optionally, the elastomeric blasting plug, prior to detonation, further comprises a chamber extending from the elastomeric blasting plug top end to the elastomeric plug bottom end, the chamber housing a fuse, the fuse having a fuse top end located above the elastomeric blasting plug top end and a fuse bottom end located below the elastomeric blasting plug bottom end and connected to the explosive charge. Optionally, the method further comprises detonating the explosive charge using the fuse. Optionally, the elastomeric blasting plug comprises a center and the chamber and is offset relative to the elastomeric blasting plug center. Optionally, the diameter of the substantially circular base of each unit is greater than the hole width of step a). Optionally, the elastomeric blasting plug is comprised of polyurethane. Optionally, there is a gap of at least about 6 inches between the explosive charge and the bottom end of the elastomeric blasting plug. Optionally, in the relaxed state, the diameter of the base of each unit is substantially equal in size and the diameter of the stem of each unit is substantially equal in size. Optionally, no stemming material is placed on top of the elastomeric blasting plug top end prior to stem e).

BRIEF DESCRIPTION OF THE DRAWINGS

in FIGS. 1-5, the bore hole is partially cut-away in order to better show the elastomeric blasting plug and in FIGS. 1-3, the elastomeric blasting plug is in the relaxed state.

FIG. 2 illustrates a top plan view of the elastomeric blasting plug of FIG. 1.

FIG. 3 illustrates a side isometric view of the elastomeric blasting plug of FIG. 1.

FIG. 4 illustrates a side isometric view of the elastomeric blasting plug of FIG. 1 after inserting in the bore hole.

FIG. 5 illustrates a side isometric view of the elastomeric blasting plug of FIG. 1 after detonating the explosive charge; in FIG. 5, the elastomeric blasting plug is in the expanded state.

DETAILED DESCRIPTION

Figure 1:
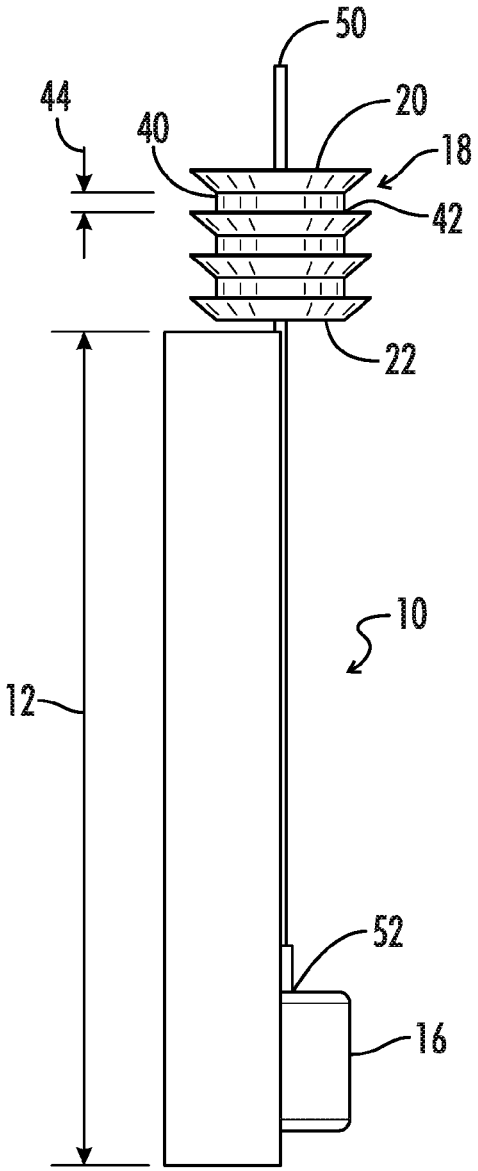
FIG. 1 illustrates a side elevation view of a blasting plug of one embodiment of the present invention prior to inserting in the bore hole.

With reference to FIGS. 1-5 provides a blasting plug generally designated by the numeral 18. In the drawings, not all reference numbers are included in each drawing for the sake of clarity.

Figure 3:
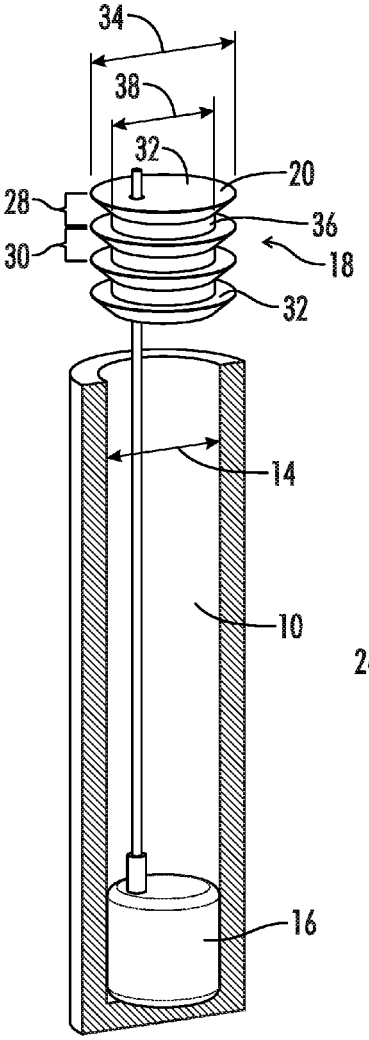
Figure 4:
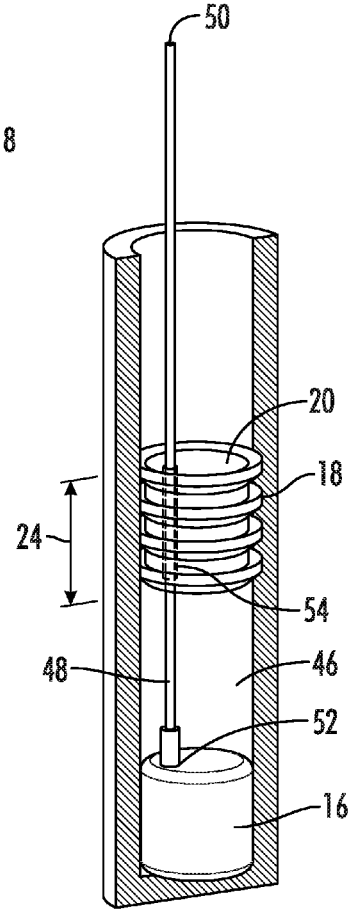
Figure 5:
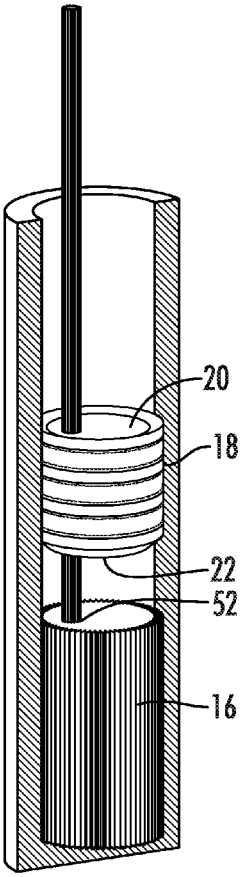

FIGS. 1-5 are drawn to scale, however, it will be appreciated that other dimensions are possible. In addition, the blasting plug 18 preferably undergoes the shape changes upon insertion into the bore hole 10 (shown in FIG. 4) and the lateral expansion of the stem 36 as shown in FIG. 5 and described below.

Figure 2:
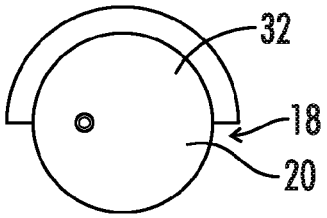

Referring further to FIGS. 1-5, the present disclosure provides a method of placing a blasting plug 18 in a hole 10 in the ground comprising the steps of: a) forming a hole 10 in the ground (the hole 10 is also referred to herein as a bore hole), the hole 10 having a hole height 12 and a hole width/diameter 14 perpendicular to the hole height 12; b) placing an explosive charge 16 in the hole 10; c) providing an elastomeric blasting plug 18 having a top end 20, a bottom end 22, a blasting plug height 24 extending from the top end 20 to the bottom end 22, the elastomeric blasting plug 18 having a relaxed state in which the elastomeric blasting plug 18 comprises a plurality of stacked units comprising at least an upper unit 28 and an adjacent lower unit 30 located below the upper unit 28, each unit 28/30 having a substantially circular base 32 having a base diameter 34, and a stem 36 located below the base 32, the stem 36 having a stem diameter 38, a stem top end 40, a stem bottom end 42, and a stem height 44 extending from the stem top end 40 to the stem bottom end 42 and generally parallel to the elastomeric blasting plug height 24 and generally perpendicular to the stem diameter 38, the elastomeric blasting plug 18 tapering in diameter from the base 32 to the stem top end 40, the stem top end 40 and stem bottom end 42 having a reduced diameter 38 compared to the base diameter 34, the stem diameter 38 substantially constant diameter along the stem height 44, and further wherein the stem bottom end 42 of the upper unit 28 adjoins the base 32 of the adjacent lower unit 30 located below the upper unit 28; placing the elastomeric blasting plug 18 in the bore hole 10 above the explosive charge 16 and e) detonating the explosive charge 16 to cause the elastomeric blasting plug 18 to move to an expanded state in which the stem diameter 38 is increased relative to the relaxed state and in which the elastomeric blasting plug 18 is substantially cylindrical in shape. In other words, the stem 36 of the elastomeric blasting plug 18 expands radially in the expanded state. The relaxed state is shown in FIGS. 1-3 and the expanded state is shown in FIG. 5. The blasting plug 18 is said to accommodate radial expansion due to its elastomeric nature The elastomeric blasting plug 18 may also include a chamber 54 that is offset from the center of the elastomeric blasting plug 18, accommodates a fuse 48 and extends through the body of the elastomeric blasting plug 18. Optionally, except for the chamber 54, the elastomeric blasting plug 18 is solid.

In particular, the method may further include detonating the explosive charge 16 using a fuse 48 having a fuse top end 50 located above the elastomeric blasting plug top end 20 and a fuse bottom end 52 located below the elastomeric blasting plug bottom end 22 and connected to the explosive charge 16. Any suitable fuse may be used. Preferably, the fuse 48 is in the form of a shock tube or a fuse of the like sold under the brand name PRIMACORD (Dyno Nobel, Inc. Delaware) that comprises an explosive and creates a lateral explosion, causing the elastomeric blasting plug 18 to expand to the expanded state, as shown in FIG. 5. PRIMACORD detonating cords are flexible linear explosives with a core of PETN explosive encased in a textile outer jacket.

Optionally, the diameter 34 of the substantially circular base 32 of each unit 28/30 is greater than the hole width 14 of step a). In other words, preferably, the elastomeric blasting plug 18 is oversized relative to the hole 10, which allows a gap 46 to be between the explosive charge 16 and the bottom end 22 of the elastomeric blasting plug 18. The size of the gap 46 may be varied by the user. Optionally, there is a gap 46 of at least about 6 inches between the explosive charge 16 and the bottom end 22 of the elastomeric blasting plug 18.

In the exemplary embodiment shown in FIGS. 1-4, the elastomeric blasting plug 18 includes four similarly sized stacked units. However, more or fewer units may be used.

The elastomeric blasting plug 18 may taper at a constant angle as shown in FIGS. 1-3.

The material comprising the elastomeric blasting plug 18 preferably is able to withstand temperatures of 10,500° F. for 1 second. Preferably, the elastomeric blasting plug 18 is comprised of polyurethane because, though it ignites at the temperature conditions, the ignition is quickly blown out by the gases created by the ignition. Steel is not a desired material because it sparks and it is prohibited due to government regulations. Plastic is also not a preferred material because it melts.

Optionally, in the relaxed state, the diameter 34 of the base 32 of each unit 28/30 is substantially equal in size and the diameter 38 of the stem 36 of each unit 28/30 is substantially equal in size.

Optionally, no stemming material such as gravel is placed on top of the elastomeric blasting plug top end 20 prior to detonation.

Without being bound by any particular theory, the elastomeric blasting plug 18 preferably creates an air seal with the bore hole 10, allowing air to pass during insertion of the elastomeric blasting plug 18 (as the air headspace becomes compressed) but resisting air flow when the elastomeric blasting plug 18 is fully inserted into its final resting position, as shown in FIG. 4. This air seal provides another means to retain the elastomeric blasting plug 18 in its final position prior to detonation, in addition to sidewall fraction between the elastomeric blasting plug 18 and the bore hole 10.

Having now described the invention in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

What is claimed is:

1. A method of detonating an explosive charge comprising the steps of:

a) forming a hole in the ground, the hole having a hole height and a hole width perpendicular to the hole height;

b) placing an explosive charge in the hole;

c) providing an elastomeric blasting plug having an elastomeric blasting plug top end, an elastomeric blasting plug bottom end, an elastomeric blasting plug height extending from the elastomeric blasting plug top end to the elastomeric blasting plug bottom end, the elastomeric blasting plug having a relaxed state in which the elastomeric blasting plug comprises a plurality of stacked units comprising an upper unit and an adjacent lower unit located below the upper unit, each unit having a substantially circular base having a base diameter, and a stem located below the base, the stem having a stem diameter, a stem top end, a stem bottom end, and a stem height extending from the stem top end to the stem bottom end and generally parallel to the elastomeric blasting plug height and generally perpendicular to the stem diameter, the elastomeric blasting plug tapering in diameter from the base to the stem top end, the stem top end and the stem bottom end having a reduced diameter compared to the base diameter, the stem diameter being a substantially constant diameter along the stem height, and further wherein the stem bottom end of the upper unit adjoins the base of the adjacent lower unit located below the upper unit;

d) placing the elastomeric blasting plug above the explosive charge; and e) detonating the explosive charge to cause the elastomeric blasting plug to move to an expanded state in which the stem diameter is increased relative to the relaxed state and in which the elastomeric blasting plug is substantially cylindrical in shape.

2. The method of claim 1, wherein the elastomeric blasting plug further comprises a chamber extending through the elastomeric blasting plug from the elastomeric blasting plug top end to the elastomeric blasting plug bottom end, the chamber housing a fuse comprised of an explosive material, the fuse having a fuse top end located above the elastomeric blasting plug top end and a fuse bottom end located below the elastomeric blasting plug bottom end and connected to the explosive charge.

3. The method of claim 2, wherein the method further comprises detonating the explosive charge using the fuse.

4. The method of claim 2, wherein the elastomeric blasting plug comprises a center and the chamber and is offset relative to the elastomeric blasting plug center.

5. The method of claim 1 wherein the diameter of the substantially circular base of each unit is greater than the hole width of step a).

6. The method of claim 1 wherein the elastomeric blasting plug is comprised of polyurethane.

7. The method of claim 1 wherein there is a gap of at least about 6 inches between the explosive charge and the bottom end of the elastomeric blasting plug.

8. The method of claim 1, wherein, in the relaxed state, the diameter of the base of each unit is substantially equal in size and the diameter of the stem of each unit is substantially equal in size.

9. The method of claim 1, wherein no stemming material is placed on top of the elastomeric blasting plug top end prior to step e).

* * * * *